US006984012B2

(12) United States Patent
Asauchi

(10) Patent No.: US 6,984,012 B2
(45) Date of Patent: Jan. 10, 2006

(54) CARTRIDGE AND RECORDING APPARATUS

(75) Inventor: Noboru Asauchi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/638,730

(22) Filed: Aug. 11, 2003

(65) Prior Publication Data

US 2004/0090832 A1 May 13, 2004

(30) Foreign Application Priority Data

Aug. 12, 2002 (JP) ..... 2002-234696

(51) Int. Cl.
*B41J 29/393* (2006.01)
*B41J 2/175* (2006.01)

(52) U.S. Cl. ..... 347/19; 347/86

(58) Field of Classification Search ..... 347/5, 347/19; 358/1.16, 1.17; 399/12, 13; 711/103, 711/115; 714/5, 6, 53
See application file for complete search history.

(56) References Cited

U.S. PATENT DOCUMENTS 4,637,024 A * 1/1987 Dixon et al. ..... 714/819
5,365,312 A * 11/1994 Hillmann et al. ..... 399/12
5,590,278 A * 12/1996 Barthel et al. ..... 714/53
5,832,205 A * 11/1998 Kelly et al. ..... 714/53
6,009,542 A * 12/1999 Koller et al. ..... 714/53
6,155,664 A 12/2000 Cook
6,158,850 A 12/2000 Cook
6,196,670 B1 * 3/2001 Saruta ..... 347/86
6,302,527 B1 10/2001 Walker
6,312,106 B1 11/2001 Walker
6,351,618 B1 * 2/2002 Pollocks, Jr. ..... 399/12
6,494,559 B1 12/2002 Tsuji
6,549,732 B2 * 4/2003 Yoshizaki et al. ..... 399/12
2001/0019343 A1 9/2001 Walker et al.
2002/0018657 A1 * 2/2002 Serizawa ..... 399/27
2002/0057319 A1 5/2002 Saruta et al.
2002/0191038 A1 12/2002 Tsuji

FOREIGN PATENT DOCUMENTS

CN 1338992 A 3/2002
EP 1000752 A2 5/2000

(Continued)

OTHER PUBLICATIONS

European Search Report dated Dec. 23, 2003 for European Patent Application No. EP-03017625.9.

(Continued)

*Primary Examiner*—Thinh Nguyen
(74) *Attorney, Agent, or Firm*—Stroock & Stroock & Lavan LLP

(57) ABSTRACT

An ink cartridge has a memory controller that controls a series of processing that involves rewriting data into a memory. The memory stores information regarding the ink cartridge, for example, a residual quantity of ink in the ink cartridge. A control unit of a printer gives the ink cartridge an instruction including a specified address to execute an operation of rewriting the data in the memory (either an operation of erasing the existing data from the memory or an operation of writing data into the memory). In response to the given instruction, the memory controller rewrites the data at the specified address in the memory and sends back a response signal or an acknowledgement representing completion of the rewriting operation, together with address-related information corresponding to the specified address. The control unit receives the address-related information and verifies whether data has been rewritten correctly at a right address. This arrangement ensures a sufficiently high reliability in the operation of rewriting data into the memory.

20 Claims, 12 Drawing Sheets

FOREIGN PATENT DOCUMENTS

| | | | | |
|---|---|---|---|---|
| EP | 1114726 | A1 | | 7/2001 |
| EP | 1136268 | A1 | | 9/2001 |
| EP | 1156490 | A1 | | 11/2001 |
| EP | 1164022 | A2 | | 12/2001 |
| EP | 1 170 132 | A3 | | 1/2002 |
| EP | 1213148 | A1 | | 6/2002 |
| EP | 1164022 | A3 | | 8/2003 |
| EP | 1 389 528 | A1 | | 2/2004 |
| GB | 2 347 649 | A | | 9/2000 |
| GB | 2354735 | A | * | 4/2001 |
| WO | WO-98/04414 | A1 | | 2/1998 |
| WO | 01/025017 | | | 4/2001 |

OTHER PUBLICATIONS

French Search Report dated Mar. 10, 2004 for French Patent Application No. 0309834000.

UK Search Report dated Feb. 6, 2004 for UK Patent Appn. No. GB 0318685.5.

Examination Report under Section 18(3), dated Sep. 10, 2004, in counterpart UK patent application GB0318685.5.

Office Action in Chinese patent application 03153091.5 (Jul. 22, 2005).

* cited by examiner

CARTRIDGE AND RECORDING APPARATUS

BACKGROUND OF THE INVENTION

1. Field of the Invention

The present invention relates to a cartridge that has a chamber for holding a recording material used for recording therein. More specifically the invention pertains to a cartridge with a built-in non-volatile memory and a technique of transmitting information to and from such a cartridge.

2. Description of the Related Art

Recording apparatus that eject inks on printing paper to record images, such as ink jet printers, and recording apparatus that utilize toners for recording have widely been used. A cartridge attached to such a recording apparatus has a chamber for holding a recording material like ink or toner therein. Management of the residual quantity of the recording material is an important technique in the recording apparatus. The recording apparatus counts the consumption of the recording material according to the software program. Data on the residual quantity of the recording material computed from the observed count are stored in a memory of the recording apparatus for the management purpose. The same data may also be stored in a built-in memory of the cartridge.

A non-volatile memory is applicable for the built-in memory of the cartridge. The non-volatile memory enables data, such as the residual quantity of ink, to be kept even after detachment of the cartridge from the recording apparatus. Application of such a memory ensures consistent management of the residual quantity of ink and other data even when the replaced cartridge is attached again to the recording apparatus.

An important issue of such cartridges with the built-in memory is to ensure a sufficiently high reliability in the storage content of the memory. There are two primary causes of lowering the reliability in the storage content of the memory. One cause is an accidental cutoff of the power supply to the recording apparatus in the course of updating data into the cartridge or a careless detachment of the cartridge in the course of updating data. In such cases, it is practically impossible to verify the updated storage content in the memory of the cartridge. The other cause is a failed electrical connection. The cartridge is basically designed to be freely attachable to and detachable from the recording apparatus so that no fixed signal line is usable for connection with the memory in the cartridge. This may cause a loose contact or another failure in electrical connection.

One possible measure carries out the memory updating operation a plurality of times. Another possible measure provides duplicate memories and writes identical data into the duplicate memories. In the case of a loose connection of a signal line, however, these measures do not heighten the reliability. When an electrically erasable semiconductor memory (EEPROM) is applied for the built-in memory of the cartridge, the data rewriting procedure first erases the existing data in the memory and then writes new data into the memory. This requires two normal accesses for erasing and writing data and thus demands a high reliability.

SUMMARY OF THE INVENTION

The object of the present invention is thus to remove the drawbacks of the prior art techniques and to ensure a sufficiently high reliability in the operation of updating data in a cartridge equipped with a memory.

In order to attain at least part of the above and the other related objects, the present invention is directed to a cartridge that holds a recording material used for recording therein and is mounted on a recording apparatus. The cartridge includes: a memory that stores information regarding the cartridge in a non-volatile manner; an instruction reception module that receives an external instruction including at least a specified address of the memory with regard to a series of processing that involves rewriting a storage content of the memory; a processing execution module that executes the series of processing that involves rewriting the storage content at the specified address of the memory; and an output module that outputs specific data corresponding to the specified address after execution of the series of processing.

The cartridge has the memory that stores the cartridge-related information in a non-volatile manner and receives an external instruction including at least a specified address of the memory with regard to a series of processing that involves rewriting the storage content of the memory. The cartridge executes the series of processing that involves rewriting the storage content at the specified address of the memory in response to the given external instruction, and outputs specific data corresponding to the specified address. The specific data corresponding to the specified address may be identical with the specified address or data representing multiple upper bits or multiple lower bits of the specified address. The specific data may otherwise be a checksum of the specified address, a cyclic redundancy code (CRC), or a hamming code. The recording apparatus, which has given the external instruction with regard to the series of processing that involves rewriting the storage content of the memory, reads the output data and verifies whether the series of processing has been executed successfully at the specified address.

The series of processing that involves rewriting the storage content of the memory may be an operation of writing data into the memory or an operation of erasing data from the memory. In some memories, the data erasing operation is required prior to the data writing operation. In such cases, the series of processing includes the data erasing operation and the subsequent data writing operation.

When the series of processing that involves rewriting the storage content of the memory is the data erasing operation, it is preferable that the externally specified address with regard to the data erasing operation has a redundancy of at least 2. The data erasing operation eliminates the storage content of the memory, so that the high redundancy of the specified address, for example, duplication of the address, is desirable. For example, the redundancy of at least 2 possessed by the specified address is attained by a signal corresponding to the specified address and a signal generated by changing bits of the specified address according to a preset rule. Here the preset rule may be at least one of a reciprocal operation, a complementary operation, and a bit rotation.

The data output by the output module in response to the externally specified address may be any data corresponding to the specified address; for example, data identical with the specified address, data representing a predetermined part of the specified address, or a code induced from the specified address like a parity code, a hamming code, or a CRC. These codes desirably reduce the number of bits included in the output data, compared with the number of bits constituting the specified address.

The output module may output the specific data together with a signal representing completion of the series of processing, after conclusion of the series of processing that involves rewriting the storage content of the memory. The specific data may otherwise be output separately from the signal representing completion of the series of processing. The simultaneous output desirably shortens the total processing time, whereas the separate output desirably enhances the degree of freedom in data structure.

The data rewritten in the memory may be data regarding a residual quantity or a consumption of the recording material held in the cartridge, data relating to a state of the processing, data regarding occurrence of any abnormality, data regarding the frequency of detachment of the cartridge or accumulation of the use time of the cartridge, or data regarding the working environment, for example, the temperature and the humidity.

The recording material held in the cartridge may be a preset color ink used for a printer or another recording apparatus or a toner for a photocopier, a facsimile, or a laser printer. The recording material may be any material that allows for recording in any manner, for example, a material for a semiconductor or a solution of a catalyst.

The memory may be a general parallel access-type memory, but a serial access-type memory is also applicable to reduce the number of signal lines required for signal transmission. The memory desirably has non-volatility or is backed up by a battery. Preferable examples are an electrically erasable programmable memory (EEPROM) and a dielectric memory.

Data may be transmitted to and from the cartridge by wire communication or by wireless communication. The technique of partial wire communication and partial wireless communication is also applicable. In the case of wireless communication, the cartridge further includes a wireless communication module that transmits data to and from an outside by wireless communication. At least one of the instruction with regard to the series of processing that involves rewriting the storage content of the memory, the specified address, and the specific data corresponding to the specified address is transmitted via the wireless communication module. The wireless communication does not require any additional electrical connection means like a connector or a terminal and thus facilitates attachment and detachment of the cartridge.

In one preferable embodiment, the wireless communication module has a loop antenna that is used to establish the communication, and a power supply module that utilizes an electromotive force induced in the antenna to supply electric power to the cartridge. This structure does not require any additional power source, for example, a battery, in the cartridge for wireless communication. The cartridge may otherwise include a primary battery, or a secondary battery or a capacitor in addition to or in place of the primary battery.

The present invention is also directed to a recording apparatus, on which a cartridge having a chamber for holding a recording material used for recording therein is mounted. The cartridge includes: a memory that stores information regarding the cartridge in a non-volatile manner; an instruction reception module that receives an external instruction including at least a specified address of the memory with regard to a series of processing that involves rewriting a storage content of the memory; a processing execution module that executes the series of processing that involves rewriting the storage content at the specified address of the memory; and an output module that outputs specific data corresponding to the specified address after execution of the series of processing.

The recording apparatus includes: an address specification module that specifies the address at which the storage content of the memory is to be rewritten; an input module that inputs the specific data corresponding to the specified address output from the output module of the cartridge; and a verification module that compares the input specific data with the address specified by the address specification module and, when the input specific data is identical with the specified address, verifies that the series of processing that involves rewriting the storage content of the memory has been implemented normally.

The recording apparatus of the invention gives an instruction including a specified address with regard to a series of processing that involves rewriting the storage content of the memory included in the cartridge. The cartridge executes the series of processing that involves rewriting the storage content at the specified address of the memory in response to the given instruction, and outputs at least the specific data corresponding to the specified address to the recording apparatus. The recording apparatus reads the output specific data and compares the specific data with the specified address. When the specific data is identical with the specified address, the recording apparatus verifies that the series of processing that involves rewriting the storage content at the specified address of the memory has been implemented normally. This arrangement verifies whether data has been rewritten successfully at a right address and thus enhances the reliability in the storage content of the memory in the cartridge.

In one preferable arrangement of the invention, the recording apparatus compares the specific data with the address specified by the address specification module and, when the specific data is different from the specified address, causes the processing execution module of the cartridge to execute the series of processing that involves rewriting the storage content of the memory all over again and thereby correct a mistake. This further enhances the reliability in the storage content of the memory. Another preferable arrangement gives a notification representing the discrepancy, when the specific data is different from the specified address. This arrangement informs the user of the occurrence of some error and thereby enhances the reliability of the recording apparatus and the cartridge. In one preferable embodiment, the address specification module of the recording apparatus specifies the address by a signal representing the address at which the storage content of the memory is to be rewritten and a signal generated by changing bits of the address according to a preset rule. Here the preset rule may be at least one of a reciprocal operation, a complementary operation, and a bit rotation.

The technique of the present invention is not restricted to the cartridge or the recording apparatus of various arrangements discussed above, but is also applicable to an information transmitting method.

The present invention is thus directed to a method of transmitting information to and from a cartridge, which has a chamber for holding a recording material used for recording therein. The information transmitting method includes the steps of: giving an external instruction including at least a specified address with regard to a series of processing that involves rewriting a storage content of a memory from an outside of the cartridge, the memory being provided in the cartridge to store information regarding the cartridge in a non-volatile manner; causing the cartridge to execute the series of processing that involves rewriting the storage content at the specified address of the memory and outputting specific data corresponding to the specified address to the outside of the cartridge; and comparing the output specific data with the specified address and verifying whether the series of processing that involves rewriting the storage content of the memory has been implemented normally.

These and other objects, features, aspects, and advantages of the present invention will become more apparent from the following detailed description of the preferred embodiment with the accompanying drawings.

DESCRIPTION OF THE PREFERRED EMBODIMENTS

Figure 1:
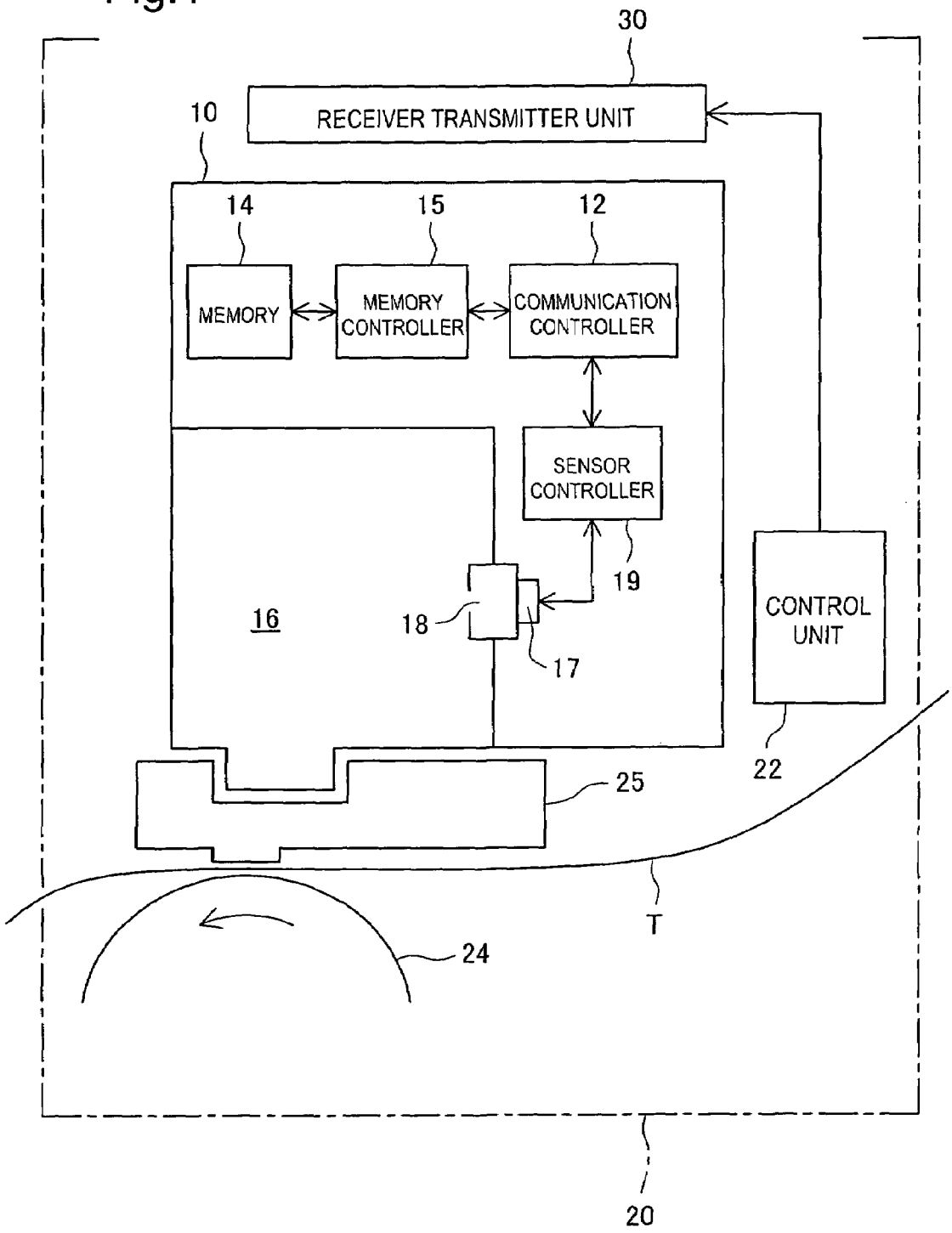
FIG. 1 schematically illustrates the structure of an ink cartridge and a printer, to which the ink cartridge is attached, in one mode of the invention.

FIG. 1 schematically illustrates the structure of an ink cartridge 10 and a printer 20 as a recording apparatus, to which the ink cartridge 10 is attached, in one mode of the invention. The printer 20 makes ink ejected from a print head 25 and thereby prints an image on printing paper T, which is transported by means of a platen 24. The printer 20 includes a control unit 22, although the internal structure of the printer 20 is not described nor illustrated specifically. The control unit 22 computes an ink consumption used for printing and other required data and transmits the computed data to the ink cartridge 10 via a receiver transmitter unit 30. Data are transmitted between the printer 20 and the ink cartridge 10 by wireless, although wire communication may be adopted alternatively. The electromagnetic induction technique is applied for wireless communication in this mode of the invention, though another technique is also applicable.

The ink cartridge 10 includes a communication controller 12 that controls communication, a memory controller 15 that controls reading and writing data from and into a memory 14, a sensor 17 of a piezoelectric element, and a sensor controller 19 that actuates and controls the sensor 17 to detect a residual level of ink. The memory controller 15 transmits data to and from the memory 14, in response to instructions output from the printer 20 and received by the communication controller 12. The data transmission includes three primary processes, that is, a process of reading data from a specified address in the memory 14, a process of erasing data from the specified address in the memory 14, and a process of writing data at the specified address in the memory 14. The sensor controller 19 actuates the sensor 17 and detects the residual level of ink by taking advantage of a variation in resonance frequency of a resonance chamber 18 provided in an ink chamber 16.

Figure 2:
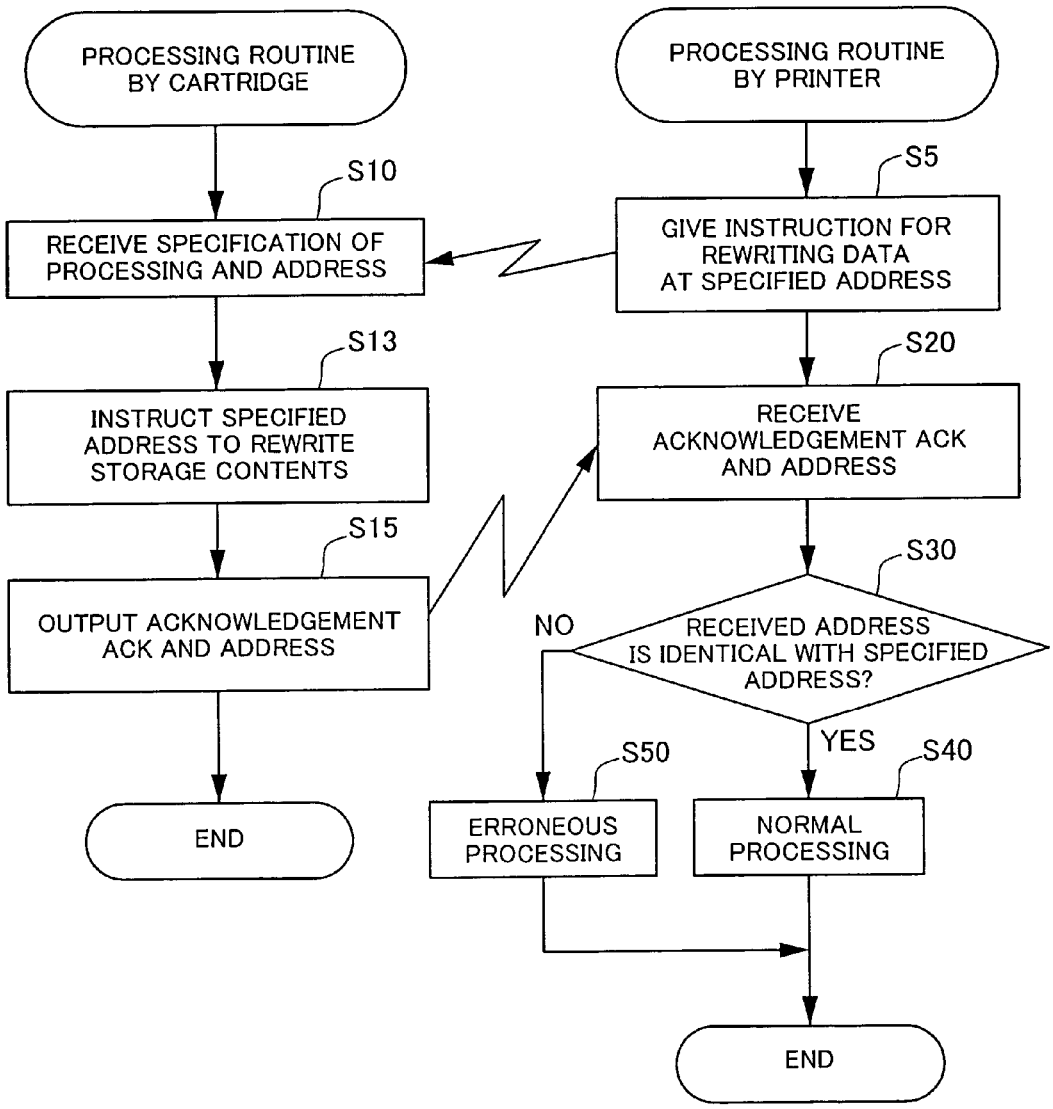
FIG. 2 is a flowchart showing a series of processing executed by a memory controller of the ink cartridge, in combination with a series of processing executed by a control unit of the printer.

FIG. 2 is a flowchart showing a series of processing executed by the memory controller 15, in combination with a series of processing executed by the control unit 22 of the printer 20. The memory controller 15 is actualized, for example, by a circuit structure including a gate array. For convenience of the explanation, however, the respective operations performed in the memory controller 15 are described according to the flowchart. The control unit 22 of the printer 20 gives an instruction for rewriting the storage contents at a specific address in the memory 14 (step S5). More specifically, the control unit 22 gives either an instruction for erasing data from the specified address in the memory 14 or an instruction for rewriting data at the specified address in the memory 14. The memory controller 15 of the ink cartridge 10 receives the given instruction including the specification of the required processing and the specified address as the object to be processed (step S10).

The memory controller 15 then instructs the specified address in the memory 14 to rewrite its storage contents (step S13). The concrete procedure of this step outputs a 1-byte operand and a 1-byte address to the memory 14. The 1-byte operand represents the specification of the required processing, for example, an erasing operation, a reading operation, or a writing operation. The address is specified by the 1-byte data in this description, but the data size may be varied according to the length of the address in the case of the memory 14 having a sufficiently large storage capacity. For the enhanced reliability, even if the capacity of 1 byte is enough for the data size of the address, the capacity of 2 bytes may be assigned to the address specification. For example, an identical address is output consecutively as the 2-byte data after the 1-byte operand representing either a rewriting or erasing operation. In another example, 1-byte complement address data may follow the 1-byte address specification data. The order of the latter 2-byte data may be inverted. Namely the instruction may include the 1-byte operand representing either a rewriting operation or an erasing operation, the 1-byte complement address data, and the 1-byte address data in this order. The 1-byte data added to the address may be obtained by a preset arithmetic operation, for example, a reciprocal operation, a complementary operation, or a bit rotation, of the bit sequence representing the address. The additional 1-byte data is not restricted to the arithmetic operation of the address, but may be a checksum of the address, a hamming code, an error correcting code, or any other suitable data.

The memory 14 receives the operand and the address output from the memory controller 14, rewrites or erases data at the specified address in response to the given instruction, and sends back a signal representing a concluded access to the memory controller 15 within a preset time. The memory controller 15 is accordingly informed of the result of the data rewriting or erasing operation at the specified address in the memory 14. The memory controller 15 then outputs an acknowledgement ACK and the 1-byte address as the object of the data rewriting operation via the communication controller 12 (step S15).

The control unit 22 of the printer 20 receives the acknowledgement ACK and the address as the object of the data rewriting operation (step S20) and compares the received address with the address specified previously by the control unit 22 (step S30). When the address received from the ink cartridge 10 is identical with the address specified previously by the control unit 22, the control unit 22 determines that data has been rewritten normally (step S40). When the received address is not identical with the specified address, on the other hand, the control unit 22 determines that there has been some error in the process of rewriting data at the specified address in the memory 14 of the ink cartridge 10 (step S50).

As described above, the technique of the invention applied to the ink cartridge 10 enables the storage contents to be rewritten at an externally specified address in the memory 14 and allows the specified address as the object of rewriting to be checked after the data rewriting operation. Even if the specified address in the memory 14 is changed by noise or another reason, this arrangement effectively informs the control unit 22 of the printer 20 of an erroneous data rewriting operation at a wrong address.

Figure 3:
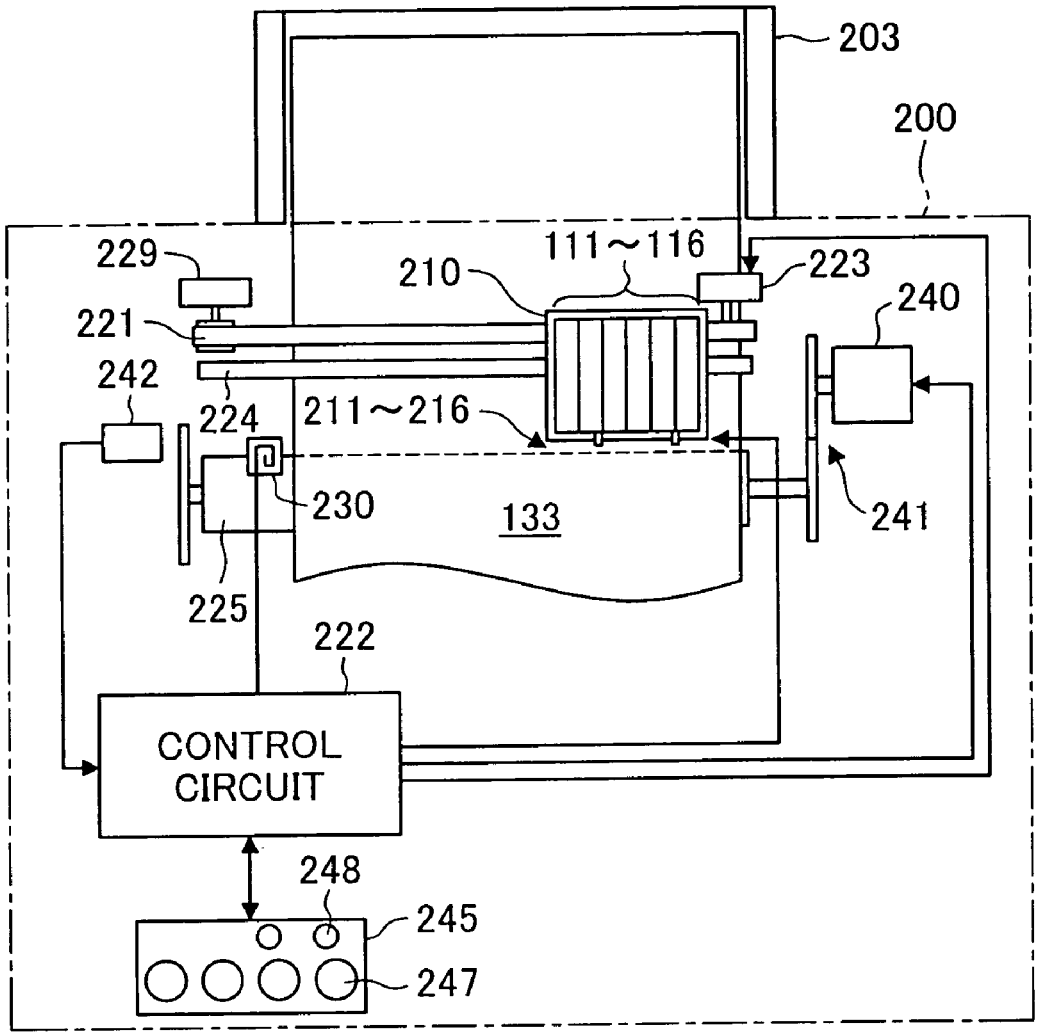
FIG. 3 schematically illustrates the structure of an ink jet printer in one embodiment of the invention.
Figure 4:
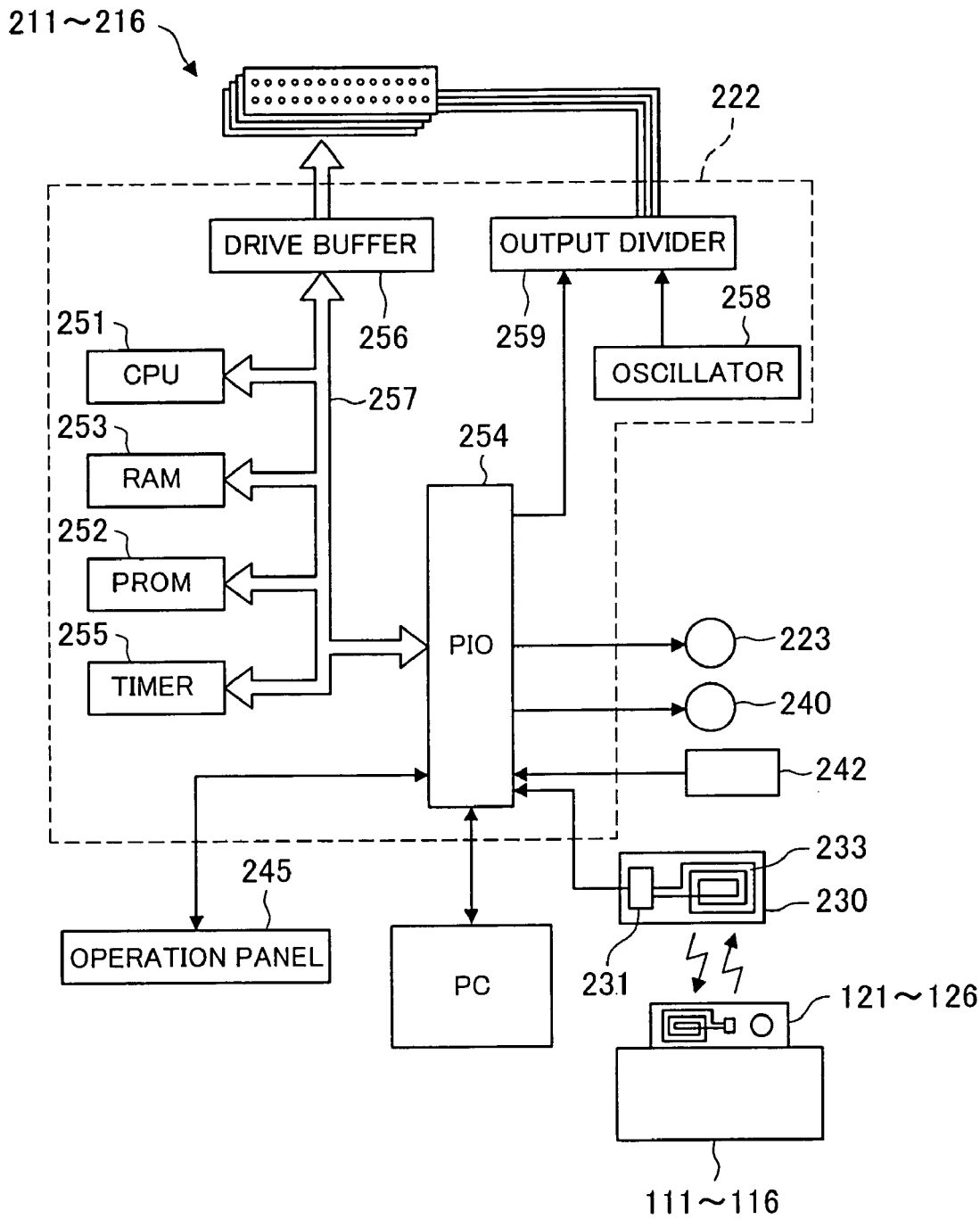
FIG. 4 shows the electric construction of a control circuit included in the printer of the embodiment.

This technique of the invention is applicable to various printers. The following describes application of the invention to an ink jet printer 200 as one embodiment. FIG. 3 schematically illustrates the structure, especially the operation-related structure, of the ink jet printer 200. FIG. 4 shows the electric construction of a control circuit 222 of the printer 200. As shown in FIG. 3, the printer 200 makes ink droplets ejected from print heads 211 through 216 onto printing paper T, which is fed from a paper feed unit 203 and is transported by means of a platen 225, so as to form an image on the printing paper T. The platen 225 is actuated and rotated by the driving force transmitted from a paper feed motor 240 via a gear train 241. The rotational angle of the platen 225 is measured by an encoder 242. The print heads 211 through 216 are mounted on a carriage 210, which moves back and forth along the width of the printing paper T. The carriage 210 is linked with a conveyor belt 221, which is actuated by a stepping motor 223. The conveyor belt 221 is an endless belt and is spanned between the stepping motor 223 and a pulley 229 arranged on the opposite side. With rotations of the stepping motor 223, the conveyor belt 221 moves to reciprocate the carriage 210 along a conveyor guide 224.

Ink cartridges 111 through 116 of six different color inks are attached to the carriage 210. The six color ink cartridges 111 through 116 basically have an identical structure and respectively store inks of different compositions, that is, inks of different colors, in their internal ink chambers. More specifically, the ink cartridges 111 through 116 respectively store black ink (K), cyan ink (C), magenta ink (M), yellow ink (Y), light cyan ink (LC), and light magenta ink (LM). The light cyan ink (LC) and the light magenta ink (LM) are regulated to have ¼ of the dye densities of the cyan ink (C) and the magenta ink (M). Detection memory modules 121 through 126 (discussed later) are attached to these ink cartridges 111 through 116, respectively. The detection memory modules 121 through 126 transmit data to and from the control circuit 222 of the printer 200 by wireless communication. In the structure of this embodiment, the detection memory modules 121 through 126 are attached to the respective side planes of the ink cartridges 111 through 116.

The printer 200 has a receiver transmitter unit 230 to establish wireless communication with and data transmission to and from these detection memory modules 121 through 126. The receiver transmitter unit 230, as well as the paper feed motor 240, the stepping motor 223, the encoder 242, and the other electronic parts, are connected to the control circuit 222. Diverse switches 247 and LEDs 248 on an operation panel 245 located on the front face of the printer 200 are also connected with the control circuit 222.

As shown in FIG. 4, the control circuit 222 includes a CPU 251 that controls the constituents of the whole printer 200, a ROM 252 that stores control programs therein, a RAM 253 that is used to temporarily register data, a PIO 254 that functions as an interface with external devices, a timer 255 that manages the time, and a drive buffer 256 that stores data for driving the print heads 211 through 216. These circuit elements are mutually connected via a bus 257. The control circuit 222 also includes an oscillator 258 and an output divider 259, in addition to these circuit elements. The output divider 259 distributes a pulse signal output from the oscillator 258 into common terminals of the six print heads 211 through 216. Each of the print heads 211 through 216 receives dot on-off data (ink ejection non-ejection data) from the drive buffer 256 and makes the ink ejected from corresponding nozzles according to the dot on-off data received from the drive buffer 256 in response to driving pulses output from the output divider 259.

A computer PC that outputs object image data to be printed to the printer 200, as well as the stepping motor 223, the paper feed motor 240, the encoder 242, the receiver transmitter unit 230, and the operation panel 245 are connected to the PIO 254 of the control circuit 222. The computer PC specifies an object image to be printed, makes the specified object image subjected to required series of processing, such as rasterizing, color conversion, and halftoning, and outputs resulting processed data to the printer 200. The printer 200 detects the moving position of the carriage 210 according to the driving quantity of the stepping motor 223, while checking the paper feed position based on the data from the encoder 242. The printer 200 expands the processed data output from the computer PC into dot on-off data representing ink ejection or non-ejection from nozzles of the print heads 211 through 216 and actuates the drive buffer 256 and the output divider 259.

The control circuit 222 transmits data by wireless to and from the detection memory modules 121 through 126 attached to the ink cartridges 111 through 116 via the receiver transmitter unit 230 connecting with the PIO 254. The receiver transmitter unit 230 accordingly has an RF conversion element 231 that converts signals from the PIO 254 into alternating current (AC) signals of a fixed frequency, and a loop antenna 233 that receives the AC signals from the RF conversion element 231. When the loop antenna 233 receives the AC signal, the electromagnetic induction excites an electric signal in another antenna located close to the loop antenna 233. The distance of wireless communication is restricted in the printer 200, so that electromagnetic induction-based wireless communication technique is adopted in the structure of this embodiment.

Figure 5A:
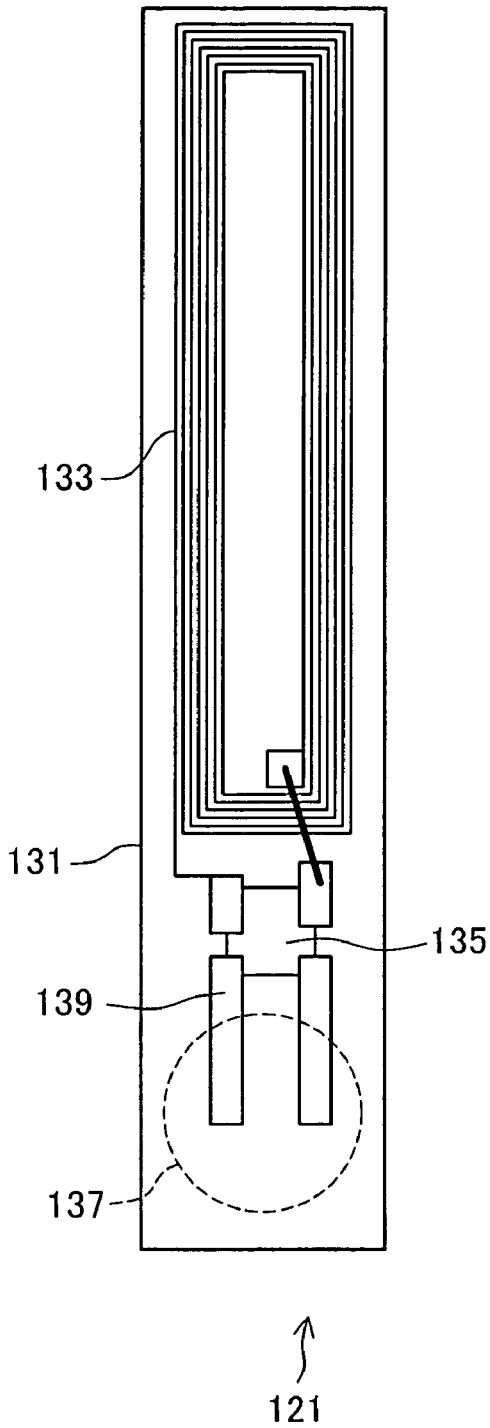
FIGS. 5A and 5B show the appearance of a detection memory module in the embodiment.
Figure 5B:
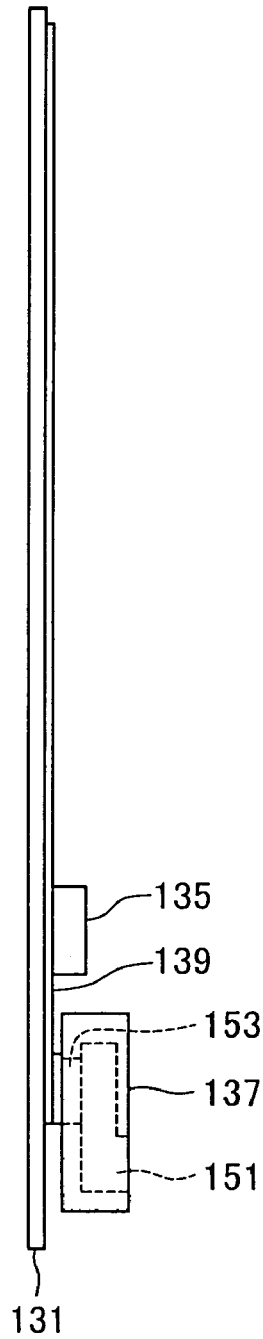

The following describes the structure of the detection memory module 121 attached to the ink cartridge 111. FIGS. 5A and 5B are a front view and a side view showing the detection memory module 121. The detection memory modules 121 through 126 mounted on the respective ink cartridges 111 through 116 have an identical structure, except ID numbers stored therein. The discussion accordingly regards the detection memory module 121 as an example. As illustrated, the detection memory module 121 has an antenna 133 formed as a metal thin film pattern on a thin film substrate 131, an exclusive IC chip 135 having diverse functions built therein as discussed later, a sensor module 137 that detects the presence or the absence of ink, and a wiring pattern 139 that mutually connects these constituents.

Figure 6:
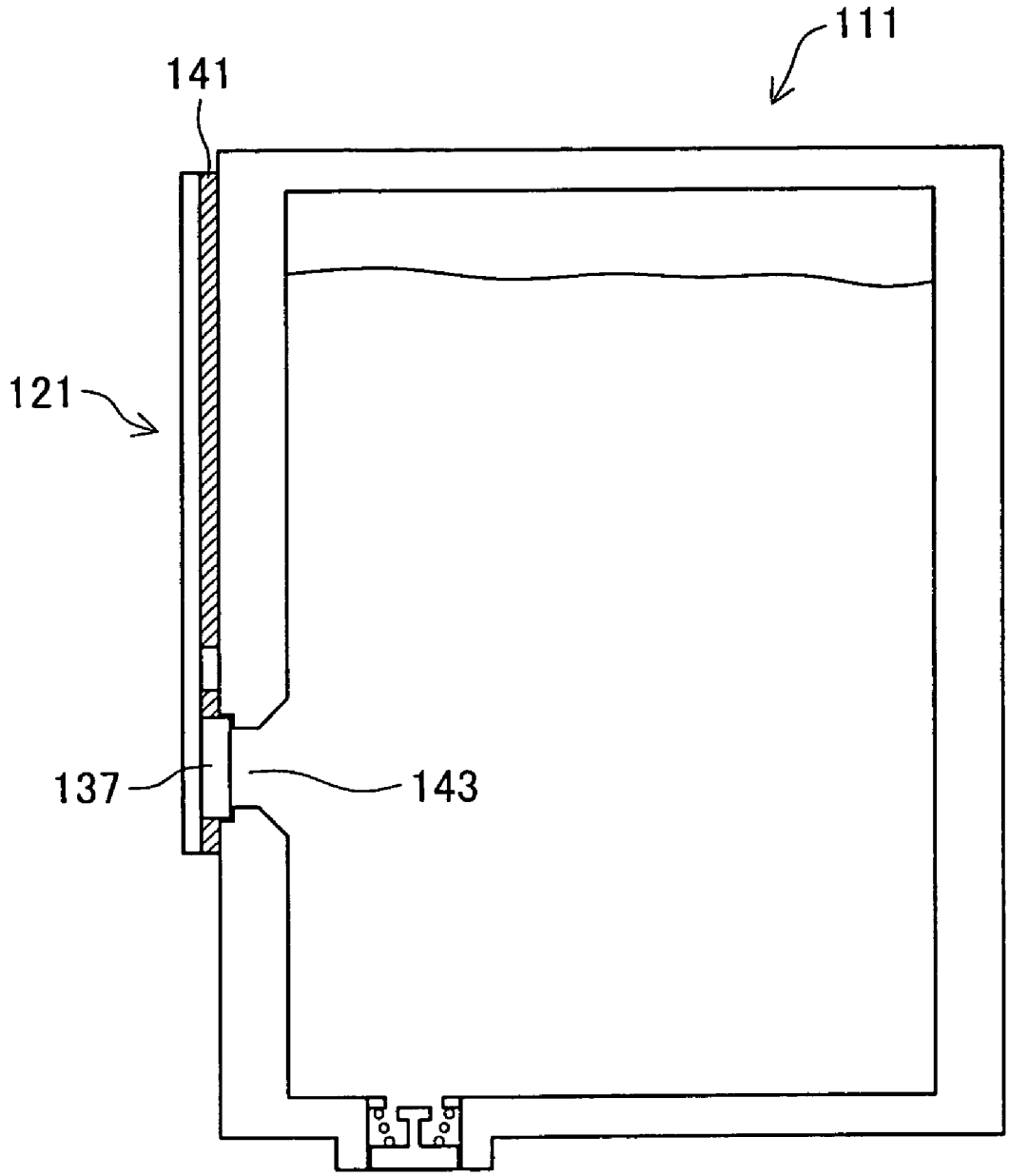
FIG. 6 is an end view showing attachment of the detection memory module to an ink cartridge in the embodiment.

FIG. 6 is an end view showing attachment of the detection memory module 121 to the ink cartridge 111. The detection memory module 121 is fixed to the side face of the ink cartridge 111 by means of an adhesive layer 141 of, for example, an adhesive or a double-faced tape. The sensor module 137 disposed on the rear face of the substrate 131 is fit in an opening 143 formed in the side plane of the ink cartridge 111. A resonance chamber 151 is formed inside the sensor module 137, and a piezoelectric element 153 functioning as a sensor is bonded to the side wall of the resonance chamber 151.

Figure 7:
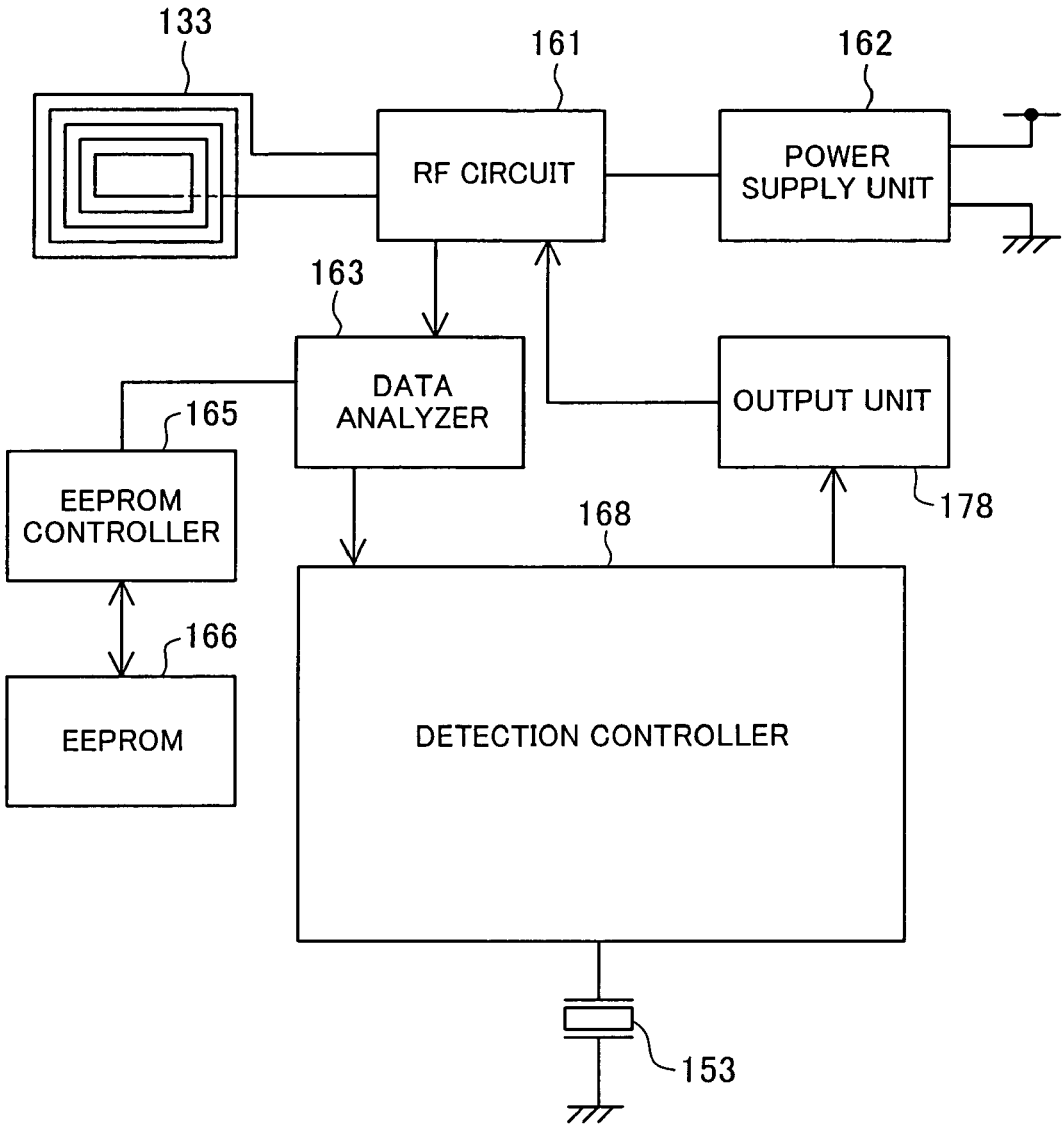
FIG. 7 is a block diagram showing the internal structure of the detection memory module.

FIG. 7 is a block diagram showing the internal structure of the detection memory module 121. The detection memory module 121 has an RF circuit 161, a power supply unit 162, a data analyzer 163, an EEPROM controller 165, an EEPROM 166, a detection controller 168 that transmits data to and from the sensor module 137 equipped with the piezoelectric element 153 to detect the residual quantity of ink, and an output unit 178, which are all built in the exclusive IC chip 135.

The RF circuit 161 demodulates an AC signal generated in the antenna 133 by the electromagnetic induction, extracts an electric power component and a signal component from the demodulated AC signal, and outputs the electric power component to the power supply unit 162 while outputting the signal component to the data analyzer 163. The RF circuit 161 also functions to receive a signal from the output unit 178 (described later), modulates the received signal to an AC signal, and transmits the modulated AC signal to the receiver transmitter unit 230 of the printer 200 via the antenna 133. The power supply unit 162 receives the electric power component from the RF circuit 161, stabilizes the received electric power component, and outputs the stabilized electric power component as power sources of the exclusive IC chip 135 and the sensor module 137. No independent power source, such as dry cells, is thus required for each of the ink cartridges 111 through 116. When the signal-induced power supply time from the receiver transmitter unit 230 is restricted, the detection memory module 121 may additionally have a charge accumulator element, such as a capacitor, that effectively accumulates the stabilized power source generated by the power supply unit 162. The charge accumulator element may be disposed before the power supply unit 162.

Figure 8A:
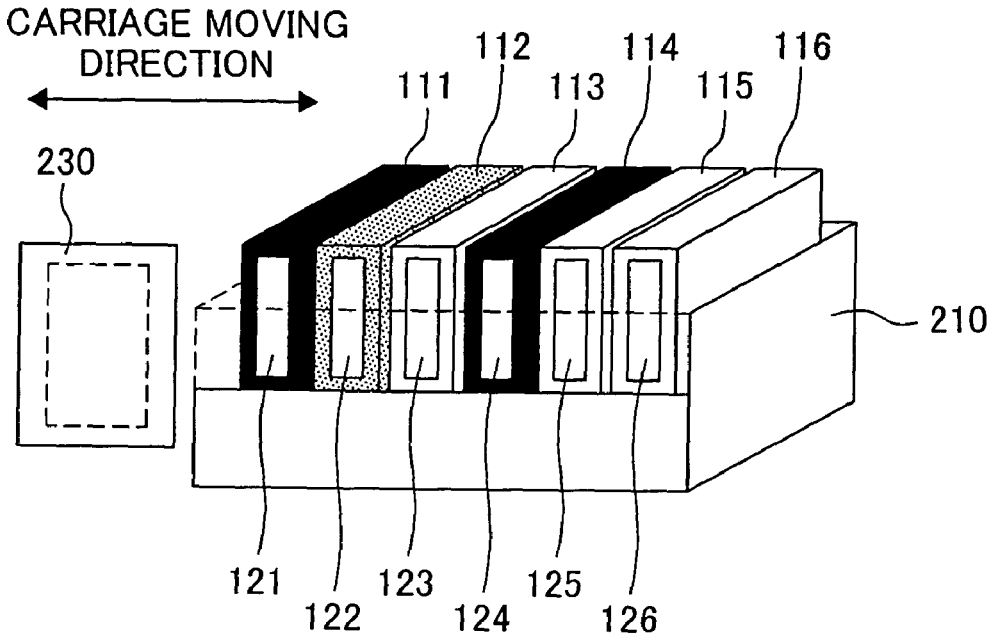
FIGS. 8A and 8B show the positional relation between a receiver transmitter unit and ink cartridges mounted on a carriage of the printer.
Figure 8B:
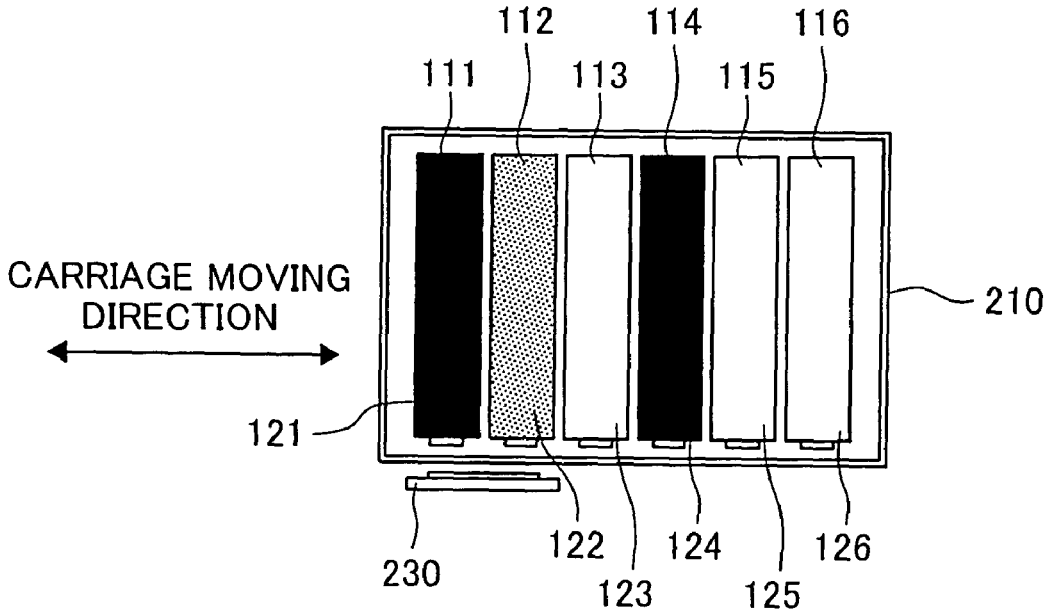

The data analyzer 163 analyzes the signal component received from the RF circuit 161 and extracts a command and data from the analyzed signal component. The data analyzer 163 specifies either data transmission to and from the EEPROM 166 or data transmission to and from the sensor module 137, based on the result of the data analysis. The data analyzer 163 also carries out identification of the object ink cartridge of the data transmission to and from either the EEPROM 166 or the sensor module 137. The details of the identification process will be discussed later, but basically the identification process identifies the ink cartridge, based on information representing the location of each ink cartridge mounted on the carriage 210 relative to the receiver transmitter unit 230 as shown in FIGS. 8A and 8B and the ID stored in each ink cartridge. FIG. 8A is a perspective view showing the positional relation between the ink cartridges 111 through 116 with the detection memory modules 121 through 126 attached thereto and the receiver transmitter unit 230. FIG. 8B shows the relative widths of the ink cartridges 111 through 116 and the receiver transmitter unit 230.

For identification of the object ink cartridge, the control circuit 222 shifts the carriage 210 to approach to the receiver transmitter unit 230. The location of the carriage 210 facing the receiver transmitter unit 230 is outside a printable range. As shown in FIGS. 8A and 8B, the detection memory modules 121 through 126 are attached to the side faces of the respective ink cartridges 111 through 116. The shift of the carriage 210 causes two detection memory modules at the maximum to enter a transmittable range of the receiver transmitter unit 230. In this state, the data analyzer 163 receives a request from the control circuit 222 via the receiver transmitter unit 230 and performs identification of the object ink cartridge and subsequent data transmission to and from the EEPROM 166 or the sensor module 137. The details of the processing will be discussed later with reference to the flowchart.

When data transmission to and from the EEPROM 166 is performed after identification of the object ink cartridge, the data analyzer 163 transfers a specified address for a reading, writing, or erasing operation and specification of the processing, that is, selection of the reading operation, the writing operation, or the erasing operation, as well as data in the case of the data writing operation, to the EEPROM controller 165. The EEPROM controller 165 receives the specified address, the specification of the processing, and the data to be written and outputs the specified address and the specification of the processing to the EEPROM 166, so as to read the existing data from the specified address of the EEPROM 166, write the received data at the specified address of the EEPROM 166, or erase the existing data from the specified address of the EEPROM 166.

Figure 9A:
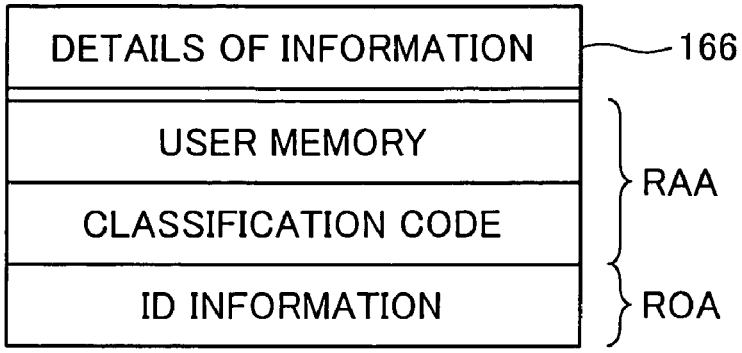
FIGS. 9A and 9B show information stored in an EEPROM as an internal memory of the detection memory module.
Figure 9B:
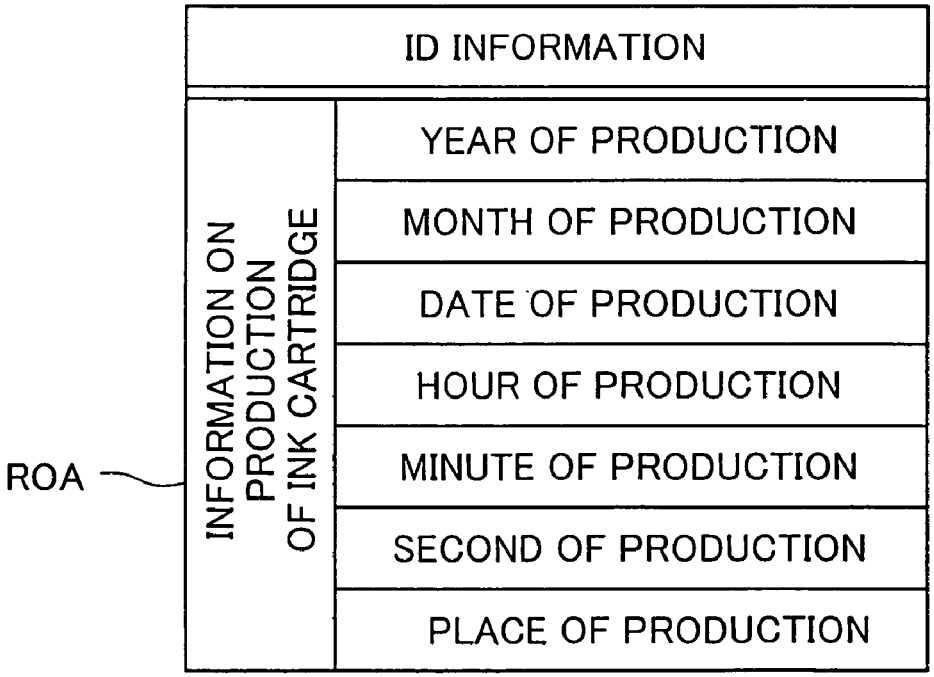

The internal data structure of the EEPROM 166 is shown in FIGS. 9A and 9B. The memory space of the EEPROM 166 is roughly divided into two sections as shown in FIG. 9A. The former section of the memory space is a readable and writable area RAA including a classification code area and a user memory area, which data like the residual quantity of ink are read from and written in. The latter section of the memory space is a read only area ROA which ID information for identifying the ink cartridge is written in.

The ID information is written into the read only area ROA prior attachment of each of the detection memory modules 121 through 126 including the EEPROM 166 to the corresponding ink cartridge 111 through 116, for example, in the manufacturing process of the detection memory module or in the manufacturing process of the ink cartridge. The printer 200 is allowed to write data into the readable writable area RAA and read and erase the existing data stored in the readable writable area RAA. The printer 200 is, however, not allowed to write data into the read only area ROA, while being allowed to read data from the read only area ROA.

The user memory area of the readable writable area RAA is used to write information regarding the residual quantity of ink in the corresponding ink cartridge 111 through 116. The printer 200 reads the information on the residual quantity of ink and may give an alarm to the user when the residual quantity of ink is below a preset level. The classification code area stores various codes for distinction of the corresponding ink cartridge. The user may use these codes according to the requirements.

The ID information stored in the read only area ROA includes production information on the corresponding ink cartridge, to which the detection memory module is attached. A typical example of the ID information regards the year, the month, the date, the hour, the minute, the second, and the place of production of the corresponding ink cartridge 111 through 116 as shown in FIG. 9B. Each piece of the ID information requires a memory area of 4 to 8 bits, so that the ID information totally occupies a memory area of 40 to 70 bits. On each power supply of the printer 200, the control circuit 222 of the printer 200 may read the ID information including the production information of the ink cartridges 111 through 116 from the detection memory modules 121 through 126 and give an alarm to the user when any of the ink cartridges has been expired or will be expired soon.

Adequate pieces of information other than the information discussed above may also be stored in the EEPROM 166 of the detection memory module 121. The whole area of the EEPROM 166 may be constructed as a readable and writable area. In this case, an electrically readable and writable memory, such as a NAND flash ROM, may be applied for the EEPROM 166 to store the ID information like the production information of the ink cartridge. In the structure of this embodiment, a serial-type memory is applied for the EEPROM 166.

When data transmission to and from the sensor module 137 is performed after identification of the object ink cartridge, on the other hand, the data analyzer 163 receives a detection condition from the control circuit 222 and transfers the received detection condition to the detection controller 168. The detection controller 18 receives the transferred detection condition, actuates the sensor module 137 according to the detection condition, and determines whether the level of the ink reaches the position of the sensor module 137, based on the variation in resonance frequency of the piezoelectric element 153. The result of the detection is sent back from the sensor module 137 to the detection controller 168. The output unit 178 receives the detection result from the detection controller 168 and outputs the detection result to the control circuit 222 of the printer 200 via the RF circuit 161.

Figure 10:
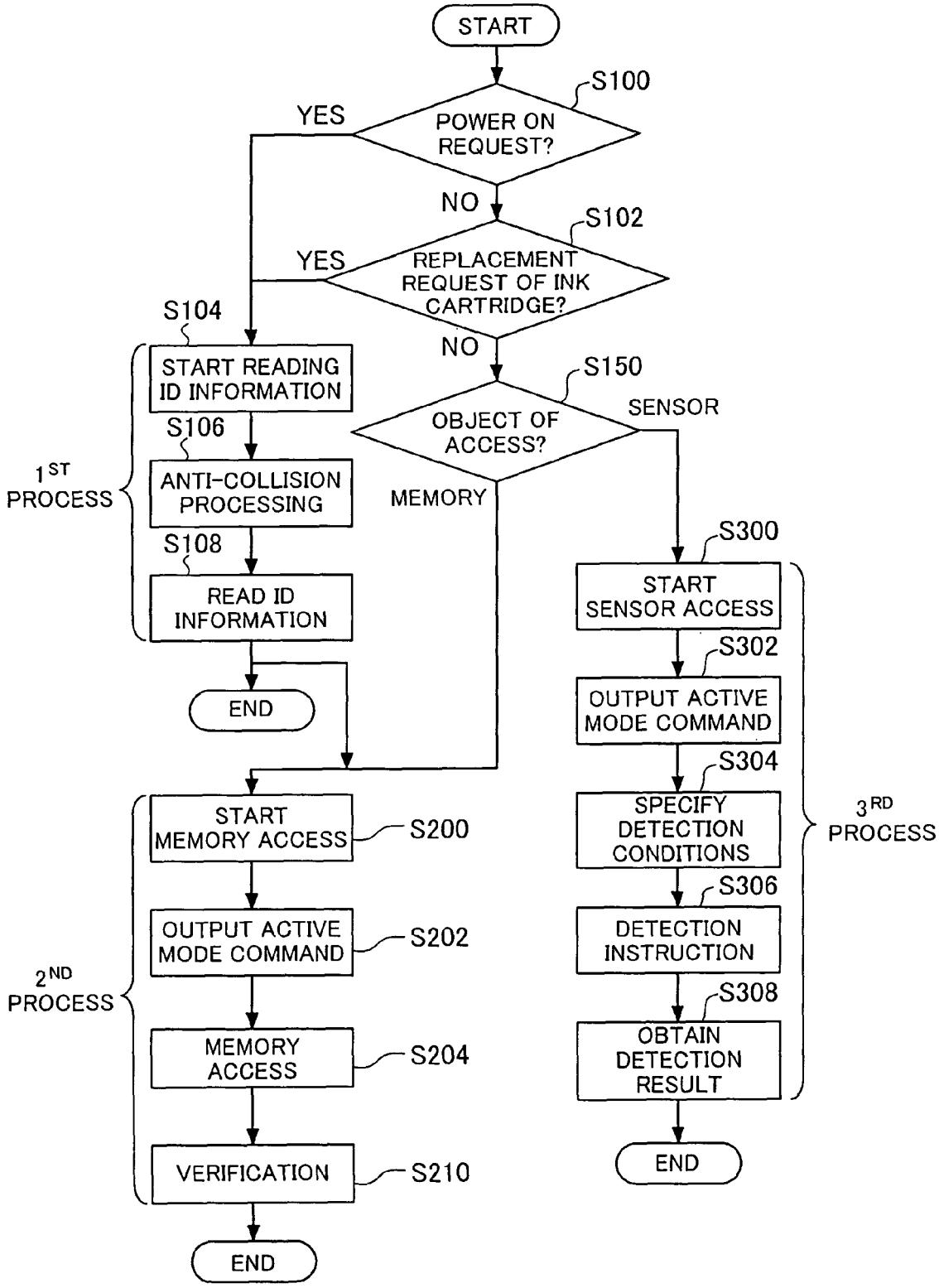
FIG. 10 is a flowchart showing a series of processing executed by the control circuit of the printer in cooperation with the detection memory module attached to each ink cartridge.

The following describes the identification of the object ink cartridge and the subsequent access, which are executed by the control circuit 222 of the printer 200 in cooperation with the data analyzer 163 of the corresponding detection memory module. FIG. 10 is a flowchart showing a series of processing executed by the control circuit 222 of the printer 200 in cooperation with the detection memory module attached to each ink cartridge through communication via the receiver transmitter unit 230. The control circuit 222 of the printer 200 and the data analyzer 163 of each detection memory module establish communication via the receiver transmitter unit 230 and carry out an ID information reading process (first process), a memory access process to read information other than the ID information and write information on the residual quantity of ink (second process), and a sensor access process to transmit data to and from the sensor module 137 (third process).

On each power supply to the printer 200, at the time of replacement of any of the ink cartridges 111 through 116 in the power ON condition, or after elapse of a preset time since previous execution of communication, the printer 200 reads the production information of the ink cartridge and writes and reads the residual quantity of ink into and from a predetermined area in the EEPROM 166. Unlike the general printing process, this series of processing require communication with each of the detection memory modules 121 through 126 via the receiver transmitter unit 230.

In order to establish communication with the detection memory modules 121 through 126, the carriage 210 with the ink cartridges 111 through 116 mounted thereon is apart from its standard printable area or a right-side non-printable area and is shifted to a left-side non-printable area where the receiver transmitter unit 230 is present. As the carriage 210 moves to the left-side non-printable area, the detection memory module approaching the receiver transmitter unit 230 receives an AC signal from the loop antenna 233 of the receiver transmitter unit 230 via the antenna 133. The power supply unit 162 extracts an electric power component from the received AC signal, stabilizes the electric power component, and supplies the stabilized electric power to the respective controllers and circuit elements to activate the controllers and the circuit elements.

When the processing routine starts with communication established between the receiver transmitter unit 230 and each of the detection memory modules 121 through 126, the control circuit 222 of the printer 200 first determines whether there is a power ON request (step S100). This step determines whether the power has just been supplied to the ink jet printer 200 to start its operations. When there is a power ON request (in the case of an affirmative answer at step S100), the first process starts to read the ID information from the respective detection memory modules 121 through 126 (step S104).

When there is no power ON request (in the case of a negative answer at step S100), on the other hand, the control circuit 222 determines that the printer 200 is carrying out the general printing process and subsequently determines whether there is a replacement request of the ink cartridges 111 through 116 (step S102). The replacement request of the ink cartridges 111 through 116 is output, for example, when the user presses an ink cartridge replacement button 247 on the operation panel 245 in the power ON state of the printer 200. In response to a press of the ink cartridge replacement button 247, the printer 200 stops the general printing process to allow for replacement of any of the ink cartridges 111 through 116. The replacement request is output after actual replacement of any of the ink cartridges 111 through 116.

When there is a replacement request of the ink cartridges 111 through 116 (in the case of an affirmative answer at step S102), the first process starts to read the ID information from the detection memory module attached to a replaced ink cartridge (step S104). When there is no replacement request of the ink cartridges 111 through 116 (in the case of a negative answer at step S102), on the other hand, the control circuit 222 determines that the ID information has already been read normally from the respective detection memory modules 121 through 126, for example, at the time of power supply and then specifies the object of access (step S150). There are two options, that is, the EEPROM 166 and the sensor module 137, as the object of access in each of the ink cartridges ill through 116 of the embodiment. When the object of access is the EEPROM 166 (in the case of selection of memory at step S150), the second process starts to gain access to one of the detection memory modules 121 through 126 (step S200). When the object of access is the sensor module 137 (in the case of selection of sensor at step S150), on the other hand, the third process starts to read the detection result from the sensor module 137.

The details of the first through the third processes are discussed. The first process is executed when the control circuit 222 detects the power ON request of the printer 200 or the replacement request of the ink cartridges 111 through 116 as mentioned above. The first process starts reading the ID information from the respective detection memory modules 121 through 126 (step S104) and carries out anti-collision processing (step S106). The anti-collision processing is required to prevent interferences when the control circuit 222 reads the ID information from the respective detection memory modules 121 through 126 for the first time. In the case of any failure or trouble in the middle of the anti-collision processing, the anti-collision processing is carried out all over again. In the structure of the embodiment utilizing wireless communication, the receiver transmitter unit 230 is always communicable with multiple detection memory modules (for example, two detection memory modules). At the start of communication, the control circuit 222 has not gained yet the ID information of the respective detection memory modules 121 through 126 attached to the ink cartridges 111 through 116 mounted on the carriage 210. The anti-collision processing is thus required to prevent interferences at this moment. The anti-collision processing is a known technique and is thus not described here in detail. The receiver transmitter unit 230 outputs a specific piece of ID information. Only a detection memory module having ID information identical with the specific piece of ID information responds to the receiver transmitter unit 230, while the other detection memory modules fall into a sleep mode. The control circuit 222 of the printer 200 establishes communication with the detection memory module of the ink cartridge, which is located in the communicable range and has the identical ID information.

On conclusion of the anti-collision processing, the control circuit 222 causes the data analyzer 163 to read the ID information from the respective detection memory modules 121 through 126 (step S108). After reading the ID information, the program may exit from this communication processing routine or may subsequently read all the data stored in the EEPROM 166 as described below.

In order to ensure the reliability of data stored in the detection memory modules 121 through 126 attached to the ink cartridges 111 through 116, the control circuit 222 reads all the data stored in the EEPROMs 166 of the respective detection memory modules 121 through 126 and stores the read-out data into the RAM 253. At the time of power supply to the printer 200, the control circuit 222 establishes communication with the respective detection memory modules 121 through 126 of the ink cartridges 111 through 116 attached to the printer 200, reads data from the EEPROMs 166 of the detection memory modules 121 through 126, and stores the read-out data into a specific area of the RAM 253. The actual flow of this procedure is similar to the second process discussed below with only difference is that this procedure sequentially reads data from all the addresses in the EEPROM 166 without any verification, which is executed in the second process. The read-out data are continuously kept in the RAM 253 and are used to correct the data registered in the ink cartridge 111 when the data in the ink cartridge 111 has poor reliability, for example, when some error arises in the ink cartridge 111 in the course of communication. Whenever rewriting the data stored in the EEPROM 166 of any of the detection memory modules 121 through 126, the control circuit 222 of the printer 200 updates data at a corresponding address in the RAM 253. This arrangement enables the data stored in the RAM 253 to be updated at required timings and thereby have high reliability.

According to the second process, the control circuit 222 initiates a memory access (step S200) and outputs an active mode command AMC to each of the detection memory modules 121 through 126 (step S202). The active mode command AMC is output together with the ID information regarding each of the detection memory modules 121 through 126. The data analyzer 163 included in each of the detection memory modules 121 through 126 compares the received ID information with the ID information stored in the detection memory module and transmits a response signal ACK showing ready for an access to the control circuit 222 only when the received ID information is identical with the stored ID information.

The control circuit 222 gains an actual memory access to the detection memory module, which has just transmitted the response signal ACK responding to the output active mode command AMC (step S204). The memory access is implemented to write data at a specified address in the EEPROM 166, to erase the existing data from the specified address in the EEPROM 166, or to read the existing data from the specified address in the EEPROM 166. In any case, the EEPROM controller 165 receives the specified address and the specification of the required processing, that is, the writing operation, the erasing operation, or the reading operation from the control circuit 222 and accesses the specified address in the EEPROM 166 to carry out the required operation.

Figure 11:
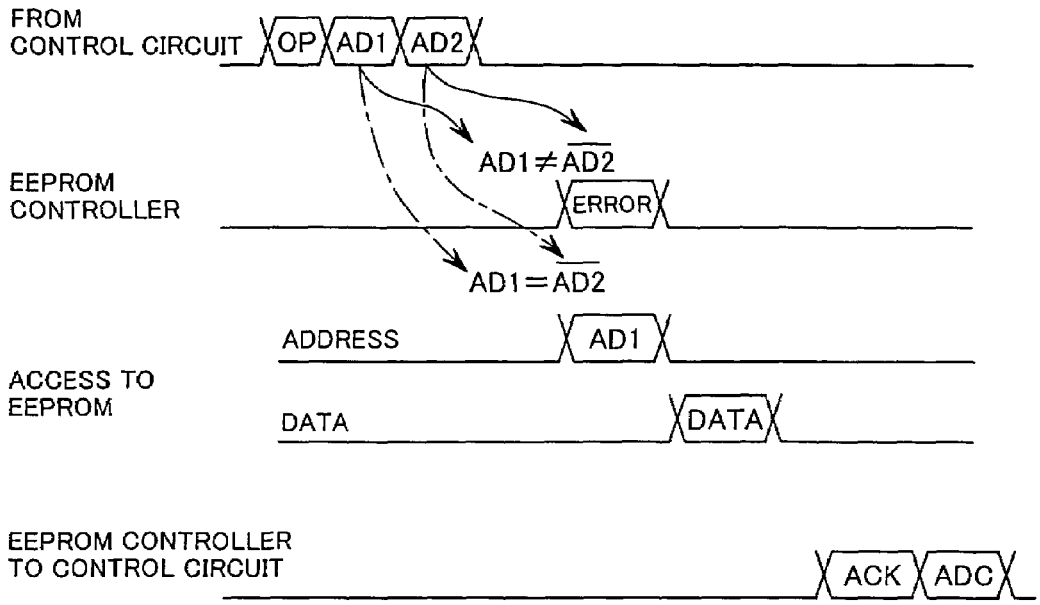
FIG. 11 is a timing chart in a data rewriting operation in the EEPROM.

The writing operation and the erasing operation are discussed in detail. FIG. 11 is a timing chart showing the writing operation and the erasing operation. The control circuit 222 outputs a 1-byte operand code OP and 2-byte address codes AD1 and AD2, which represent the specified address as the object of the writing operation or the erasing operation. The address codes AD1 and AD2 are complementary to each other, so that the address is actually specified by the 1-byte code AD1.

The EEPROM controller 165 receives the address codes AD1 and AD2 and verifies the received address codes AD1 and AD2. When the address codes AD1 and AD2 are not complementary to each other, the EEPROM controller 165 determines an erroneous specification of the address, prohibits the memory access, and outputs an error signal as shown in FIG. 11. When the address codes AD1 and AD2 are complementary to each other, on the other hand, the EEPROM controller 165 allows the writing operation or the erasing operation to be performed at the specified address AD1 in the EEPROM 166. On completion of the access to the EEPROM 166, the EEPROM controller 165 transmits a response signal ACK representing completion of the access and an address-mapping signal ADC mapped to the accessed address to the control circuit 222 via the data analyzer 163. The address-mapping signal ADC mapped to the accessed address may be identical with the specified address code AD1 or may be any of its complement, 1-bit or several-bit shifting or rotating address signals, and other processed address signals or any of error detecting and correcting codes including a checksum, a CRC, and a hamming code. The EEPROM controller 165 has access to the specified address in the EEPROM 166 in this manner at step S204.

Figure 12:
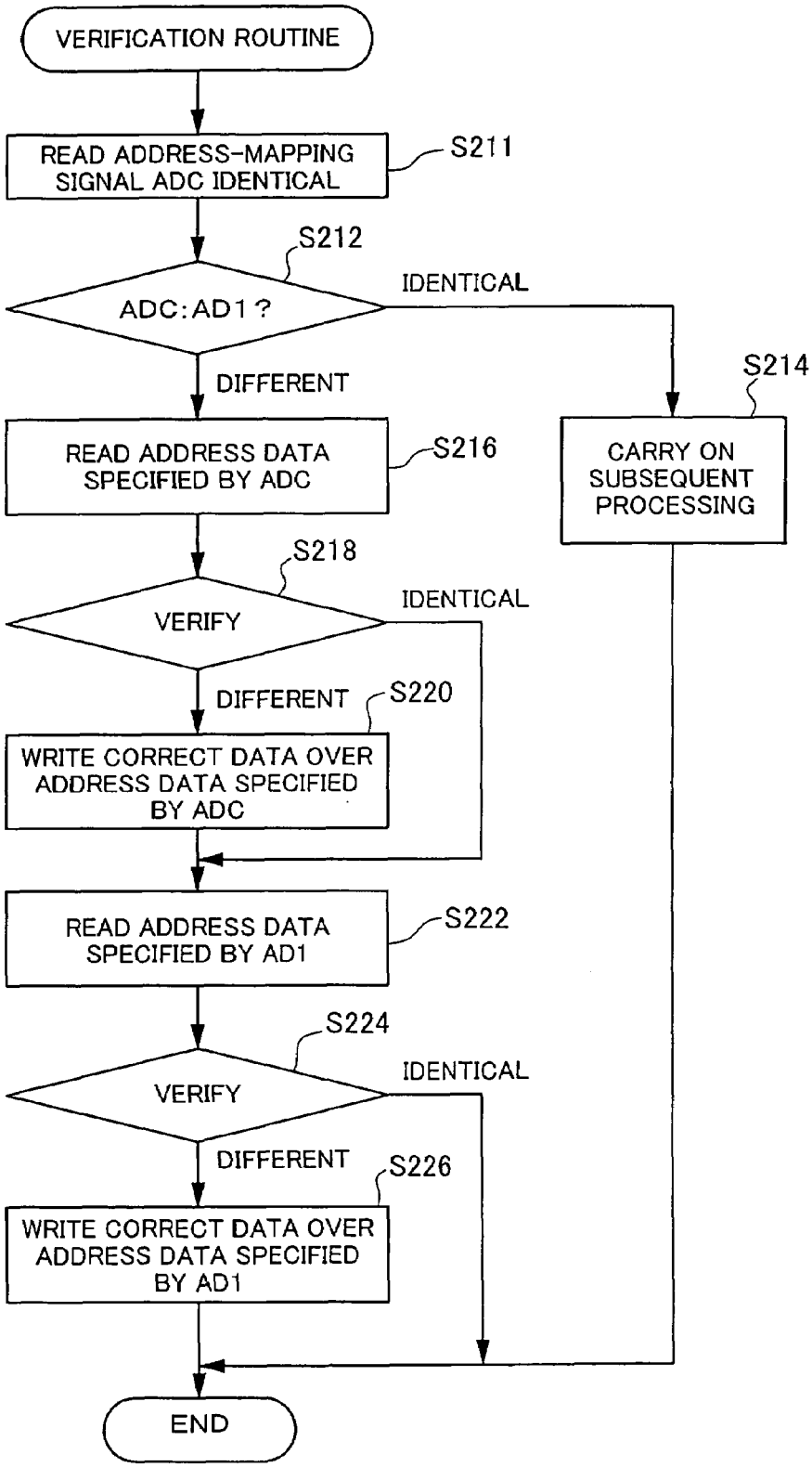
FIG. 12 is a flowchart showing a verification routine executed by the control circuit of the printer in the data rewriting operation in the EEPROM.

When the EEPROM controller 165 completes the memory access and transmits the response signal ACK representing completion of the access and the address-mapping signal ADC, the control circuit 222 executes verification according to the received address-mapping signal ADC (step S210). The details of the verification are discussed with reference to the flowchart of FIG. 12. The control circuit 222 first reads the transmitted address-mapping signal ADC (step S211) and determines whether the address-mapping signal ADC is a correct signal mapped to the specified address AD1 for access (step S212). When the address-mapping signal ADC is correctly mapped to the specified address AD1, the control circuit 222 determines that the data writing operation or the data erasing operation at the specified address AD1 has been performed successfully and carries on the subsequent processing (step S214).

When the address-mapping signal ADC is not correctly mapped to the specified address AD1, on the other hand, there is a possibility that the data writing operation or the data erasing operation has been performed mistakenly at a wrong address specified by the address-mapping signal ADC. The control circuit 222 reads address data corresponding to the address-mapping signal ADC (step S216) and verifies whether the read-out address data is identical with the address data stored in the RAM 253 (step S218). As described previously, the control circuit 222 reads all the data from the detection memory modules 121 through 126 of the ink cartridges 111 through 116 and stores the read-out data in the RAM 253 at the time of power supply to the printer 200 and occasionally updates the data stored in the RAM 253. The verification process thus reads the address data specified by the address-mapping signal ADC from the detection memory module of the ink cartridge and compares the read-out address data with the address data stored in the RAM 253 for the purpose of verification.

When the read-out address data is not identical with the stored address data, the control circuit 222 determines that the address data specified by the address-mapping signal ADC has been rewritten wrong, and writes the correct address data stored in the RAM 253 over the wrong address data specified by the address-mapping signal ADC (step S220). When the read-out address data is identical with the stored address data, on the other hand, the control circuit 222 determines that the address data specified by the address-mapping signal ADC has been written correctly, and proceeds to step S222.

After verification of the address data specified by the address-mapping signal ADC, the control circuit 222 reads the address data corresponding to the address AD1 from the detection memory module (step S222) and verifies whether the read-out address data is identical with the address data stored in the RAM 253 (step S224). Namely the verification process reads the address data specified in advance as the address AD1 from the detection memory module of the ink cartridge and compares the read-out address data with the address data stored in the RAM 253 for the purpose of verification.

When the read-out address data is not identical with the stored address data, the control circuit 222 determines that the address data specified in advance by the address AD1 has been rewritten wrong, and writes the correct address data stored in the RAM 253 over the wrong address data specified by the address AD1 (step S226). When the read-out address data is identical with the stored address data, on the other hand, the control circuit 222 determines that the address data specified by the address AD1 has been written correctly, and exits from this verification routine.

The third process is described with referring back to the flowchart of FIG. 10. The control circuit 222 initiates a sensor access to the sensor module 137 (step S300), and outputs an active mode command AMC (step S302) in the same manner as the memory access. Among the detection memory modules 121 through 126 of the ink cartridges 111 through 116 that have received the active mode command AMC, the detection memory module of the ink cartridge having the ID information identical with the ID information received with the active mode command AMC sends back a response signal ACK showing ready for an access to accept the subsequent processing.

When any of the detection memory modules 121 through 126 is activated in response to the active mode command AMC, the control circuit 222 transmits specification of detection conditions to the activated detection memory module (step S304). In this embodiment, the detection measures the resonance frequency of the piezoelectric element 153, and the detection conditions specify a start pulse of the detection of the resonance frequency of the piezoelectric element 153 (for example, the first pulse from the start of the vibration) and the number of pulses corresponding to a detection time (for example, 4 pulses). When the activated detection memory module receives the specification of detection conditions and sends back a response signal ACK, the control circuit 222 subsequently outputs a detection instruction (step S306). The detection instruction may be included in the specification of detection conditions.

In response to the detection instruction, the data analyzer 163 of the detection memory module 121 analyzes the detection instruction and instructs the detection controller 168 to carry out the detection. The detection controller 168 charges and discharges the piezoelectric element 153 according to the specified detection conditions to excite a forcible vibration of the piezoelectric element 153. The interval of charging and discharging the piezoelectric element 153 is set to make the frequency of the forcible vibration excited in the piezoelectric element 153 approach to the resonance frequency of the resonance chamber 151 in the sensor module 137.

The charge and discharge of the piezoelectric element 153 by the detection controller 168 causes the piezoelectric element 153 to vibrate at the resonance frequency of the resonance chamber 151 and generates a vibrations-induced voltage between electrodes of the piezoelectric element 153. The frequency of the vibration is basically equal to the resonance frequency determined in conformity with a property of the resonance chamber 151. The property of the resonance chamber 151 here represents an ink level in the resonance chamber 151. In the structure of this embodiment, when the resonance chamber 151 is filled with ink, the resonance frequency is approximately 90 KHz. When the ink in the resonance chamber 151 is consumed for printing to substantially empty, on the other hand, the resonance frequency is approximately 110 KHz. The resonance frequency naturally varies according to the size of the resonance chamber 151 and the properties (for example, water repellency) of the inner wall of the resonance chamber 151. The resonance frequency is thus measured for each type of the ink cartridge.

The piezoelectric element 153 vibrates at the resonance frequency of the resonance chamber 151, due to the forcible vibration excited by the voltage application. The detection controller 168 activates a built-in circuit to detect the vibration and outputs the detection result to the control circuit 222 of the printer 200 via the output unit 178. The control circuit 222 receives the detection result and specifies the presence or the absence of ink in each of the ink cartridges 111 through 116. The detection controller 168 may output some of the detection conditions specified by the control circuit 222, in addition to the frequency of the vibration of the piezoelectric element 153. The output detection condition may be identical with any of the specified detection conditions or another condition induced from the specified detection conditions. The output detection condition may be data representing a termination pulse of the detection of the resonance frequency (for example, the fifth pulse from the start of the vibration).

The control circuit 222 receives the resonance frequency as the detection result (step S308) and the output detection condition and specifies the residual quantity of ink. The residual quantity of ink is specified, based on the determination of the presence or the absence of ink in the resonance chamber 151. The control circuit 222 of the printer 200 counts the number of ink droplets ejected from each of the print heads 211 through 216 according to the software program and manages the ink consumption. The current quantity of ink in each of the ink cartridges 111 through 116 is accurately managed, based on the calculated ink consumption and the information on the presence or the absence of ink in the resonance chamber 151 received from each of the detection memory modules 121 through 126 of the ink cartridges 111 through 116.

The quantity of ink ejected at once from each of the print heads 211 through 216 varies with a variation in nozzle diameter, a variation in viscosity of ink, and a variation in ink temperature in use. The calculated residual quantity of ink based on the count of ink droplets is thus deviated from the actual residual quantity. Each of the memory detection modules 121 through 126 is designed to empty the ink in the resonance chamber 151, when approximately half the ink is consumed in each of the ink cartridges 111 through 116. The procedure detects the time when the specified ink level in each of the detection memory modules 121 through 126 has been changed from the ink presence to the ink absence and corrects the count of ink consumption at the detected time, so as to accurately manage the ink consumption. The correction may simply reset the ink consumption to ½, based on the detection result from each of the detection memory modules 121 through 126. The correction may otherwise adjust the count of ink droplets. Such correction enables an ink end of each ink cartridge (that is, a timing when ink in the ink cartridge is completely emptied out) to be accurately estimated. This arrangement desirably prevents a certain quantity of unused ink from still remaining in the ink cartridge, which has been specified as the ink end and replaced with a new ink cartridge, thus saving the valuable resource. This arrangement also prevents the ink in the ink cartridge from being emptied out prior to detection of the ink end and thus protects the print heads 211 through 216 from damages due to inkless hitting.

As described above, the control circuit 222 readily verifies whether the data rewriting operation (either the data erasing operation or the data writing operation) has been implemented correctly to rewrite data at the specified address in the EEPROM 166 in any of the detection memory modules 121 through 126 attached to the ink cartridges 111 through 116. Even if data has been rewritten mistakenly at a wrong address, the arrangement of the embodiment allows the control circuit 222 to be readily informed of the wrong address. The same data are stored in both the EEPROM 166 and the RAM 253. In the case of any failure of the data rewriting operation in any of the ink cartridges 111 through 116, correct data are read from the RAM 253 and are written over the failed data.

The control circuit 222 establishes communication with each of the detection memory modules 121 through 126 attached to the ink cartridges 111 through 116 via the receiver transmitter unit 230 in the first through the third processes and in the process of rewriting data in the EEPROM 166. The control circuit 222 sequentially communicates with each of the detection memory modules 121 through 126 from the left-end detection memory module 121 to the right-end detection memory module 126. The carriage 210 successively moves by the width of one ink cartridge and establishes communication with the detection memory module of each ink cartridge at the stop position. In the structure of the embodiment, the receiver transmitter unit 230 has a width substantially corresponding to the width of two ink cartridges. The carriage 210 may thus move three times by the width of two ink cartridges and establish communication with two detection memory modules of two ink cartridges at each stop position. This arrangement desirably reduces the number of the shifting and positioning actions of the carriage 210. In this modified arrangement, the control circuit 222 executes the anti-collision processing to effectively prevent the communication with the two ink cartridges from being interfered with each other.

The embodiment discussed above is to be considered in all aspects as illustrative and not restrictive. There may be many modifications, changes, and alterations without departing from the scope or spirit of the main characteristics of the present invention. For example, the arrangement of the detection memory module discussed in the above embodiment is applicable to a toner cartridge, as well as to the ink cartridge of the ink jet printer. The detection memory module may be located on the bottom face or the top face of the ink cartridge, in place of the side face. The location of the detection memory module on the top face of the ink cartridge desirably heightens the degree of freedom in layout of the receiver transmitter unit 230 and simplifies the whole structure.

In the structure of the embodiment, the EEPROM is used as the internal memory of the ink cartridge. An SRAM or a DRAM backed up by a battery may replace the EEPROM. The internal memory of the ink cartridge may be any of other non-volatile memories, dielectric memories, and magnetic memories.

The scope and spirit of the present invention are indicated by the appended claims, rather than by the foregoing description.

What is claimed is:

1. A cartridge that holds a recording material used for recording therein and which is mountable on a recording apparatus, said cartridge comprising:

a memory that stores information regarding said cartridge in a non-volatile manner;

an instruction reception module that receives an external instruction including at least a specified address of said memory with regard to a series of processing that involves rewriting a storage content of said memory, the specified address with regard to the series of processing possessing a redundancy of at least 2;

a processing execution module that executes the series of processing that involves rewriting the storage content at the specified address of said memory; and an output module that outputs specific data corresponding to the specified address itself after execution of the series of processing.

2. A cartridge in accordance with claim 1, wherein the series of processing that involves rewriting the storage content of said memory comprises either of an operation of writing data into said memory and an operation of erasing data from said memory.

3. A cartridge in accordance with claim 2, wherein the redundancy of at least 2 possessed by the specified address has a signal corresponding to the specified address and a signal generated by changing bits of the specified address according to a preset rule.

4. A cartridge in accordance with claim 3, wherein the preset rule is at least one of a reciprocal operation, a complementary operation, and a bit rotation.

5. A cartridge in accordance with claim 1, wherein the specific data output from said output module is identical with the specified address.

6. A cartridge in accordance with claim 5, wherein said output module outputs the specific data together with a signal representing completion of the series of processing, after conclusion of the series of processing that involves rewriting the storage content of said memory.

7. A cartridge in accordance with claim 1, wherein said memory stores a residual quantity of the recording material held therein.

8. A cartridge in accordance with claim 1, wherein the recording material is a preset color ink.

9. A cartridge in accordance with claim 1, wherein the recording material is a toner for any one of a photocopier, a facsimile, and a laser printer.

10. A cartridge in accordance claim 1, wherein said memory is a serial access-type memory.

11. A cartridge in accordance with claim 1, said cartridge further comprising:

a wireless communication module that transmits data to and from an outside by wireless communication, wherein at least one of the Instruction with regard to the series of processing that involves rewriting the storage content of said memory, the specified address, and the specific data corresponding to the specified address is transmitted via said wireless communication module.

12. A cartridge in accordance with claim 11, wherein said wireless communication module comprises:

a loop antenna that is used to establish the communication; and a power supply module that utilizes an electromotive force induced in the antenna to supply electric power to said cartridge.

13. A cartridge in accordance with claim 1, wherein at least one of said instruction reception module, said processing execution module and said output module is constructed of a discrete circuit.

14. A cartridge that holds a recording material used for recording therein and which is mountable on a recording apparatus, said cartridge comprising:

a memory that stores information regarding said cartridge in a non-volatile manner;

an address decoder that receives an external instruction including at least a specified address of said memory with regard to a series of processing that involves rewriting a storage content of said memory, the specified address with regard to the series of processing possessing a redundancy of at least 2;

a rewriting execution circuit that executes the series of processing that involves rewriting the storage content at the specified address of said memory; and an output circuit that outputs specific data corresponding to the specified address itself after execution of the series of processing.

15. A recording apparatus, on which a cartridge having a chamber for holding a recording material used for recording therein, is mounted, said cartridge comprising:

a memory that stores information regarding said cartridge in a non-volatile manner;

an instruction reception module that receives an external instruction including at least a specified address of said memory with regard to a series of processing that involves rewriting a storage content of said memory;

a processing execution module that executes the series of processing that involves rewriting the storage content at the specified address of said memory; and an output module that outputs specific data corresponding to the specified address after execution of the series of processing, said recording apparatus comprising:

an address specification module that specifies the address at which the storage content of said memory is to be rewritten;

an input module that inputs the specific data corresponding to the specified address output from said output module of said cartridge; and a verification module that compares the input specific data with the address specified by said address specification module and, when the input specific data is identical with the specified address, verifies that the series of processing that involves rewriting the storage content of said memory has been implemented normally.

16. A recording apparatus in accordance with claim 15, wherein said verification module comprises a correction module that compares the input specific data with the address specified by said address specification module and, when the input specific data is not corresponding to the specified address, causes said processing execution module of said cartridge to execute the series of processing that involves rewriting the storage content of said memory.

17. A recording apparatus in accordance with claim 15, wherein said verification module comprises a notification module that compares the input specific data with the address specified by said address specification module and, when the input specific data is not corresponding to the specified address, gives a notification representing the discrepancy.

18. A recording apparatus in accordance with claim 15, wherein said address specification module specifies the address by a signal representing the address at which the storage content of said memory is to be rewritten and a signal generated by changing bits of the address according to a preset rule.

19. A recording apparatus in accordance with claim 18, wherein the preset rule is at least one of a reciprocal operation, a complementary operation, and a bit rotation.

20. A method of transmitting information to and from a cartridge, which has a chamber for holding a recording material used for recording therein, said information transmitting method comprising the steps of;

giving an external instruction including at least a specified address with regard to a series of processing that involves rewriting a storage content of a memory from an outside of said cartridge, said memory being provided in said cartridge to store information regarding said cartridge in a non-volatile manner;

causing said cartridge to execute the series of processing that involves rewriting the storage content at the specified address of said memory and outputting specific data corresponding to the specified address to the outside of said cartridge; and comparing the output specific data with the specified address and verifying whether the series of processing that involves rewriting the storage content of said memory has been implemented normally.

* * * * *